United States Patent [19]

Yano et al.

[11] Patent Number: 4,963,454

[45] **Date of Patent: * Oct. 16, 1990**

[54] METHOD FOR DEVELOPING ELECTROSTATIC IMAGES USING MAGNETIC BRUSH

[75] Inventors: Koji Yano, Tokyo; Nobuhiro Miyakawa, Ashiya; Teruaki Higashiguchi, Tokyo; Kazuo Yamamoto, Tokyo; Yoshinobu Kawakami, Tokyo, all of Japan

[73] Assignee: Mita Industrial Co., Ltd., Osaka, Japan

[ * ] Notice: The portion of the term of this patent subsequent to Sep. 16, 2005 has been disclaimed.

[21] Appl. No.: 914,579

[22] Filed: Oct. 3, 1986

Related U.S. Application Data

[63] Continuation of Ser. No. 702,657, Feb. 19, 1985, abandoned.

[30] Foreign Application Priority Data

Feb. 17, 1984 [JP] Japan ..... 59-27351

[51] Int. Cl.[5] ..... G03G 13/09

[52] U.S. Cl. ..... 430/106.6; 430/122; 430/137

[58] Field of Search ..... 430/109, 111, 137, 106.6, 430/122

[56] References Cited

U.S. PATENT DOCUMENTS 4,284,701 8/1981 Abbott et al. ..... 430/111

4,482,621 11/1984 Kashiwagi ..... 430/111

*Primary Examiner*—John L. Goodrow

*Attorney, Agent, or Firm*—Sherman and Shalloway

[57] ABSTRACT

In an electrophotographic developing method using a magnetic brush consisting of a mixture of magnetic carrier and an electroscopic toner, development is carried out at a toner concentration (Ct. %) in the mixture, which satisfies the requirement represented by the following formula:

$$Ct = k \cdot \frac{Sc}{St + Sc} \times 100$$

wherein Sc stands for the specific surface area ($cm^2/g$) of the carrier, St stands for the specific surface area ($cm^2/g$) of the toner, and k is a number of from 0.90 to 1.14.

A toner image having a high quality can be obtained according to this method.

7 Claims, 3 Drawing Sheets

METHOD FOR DEVELOPING ELECTROSTATIC IMAGES USING MAGNETIC BRUSH

This application is a continuation of application Ser. No. 702,657, filed Feb. 19, 1985 now abandoned.

BACKGROUND OF THE INVENTION (1) Field of the Invention

The present invention relates to a method for developing electrostatic images. More particularly, the present invention relates to a method for forming a toner image at a high density without fogging by developing an electrostatic image by a magnetic brush.

(2) Description of the Prior Art

In the electrophotographic process using a two-component type magnetic developer, an electroscopic toner is mixed with a magnetic carrier, the resulting two-component type composition is supplied to a developing sleeve having a magnet arranged in the interior thereof to form a magnetic brush formed of this composition, and this magnetic brush is brought into sliding contact with an electrophotographic photosensitive plate having an electrostatic latent image formed thereon. The electroscopic toner is charged with a polarity reverse to the polarity of the electrostatic latent image on the photosensitive plate by friction with the magnetic carrier, and particles of the electroscopic toner on the magnetic brush are stuck to the electrostatic latent image by Coulomb force to effect development of the electrostatic latent image. On the other hand, the magnetic carrier is attracted by the magnet arranged in the interior of the sleeve, and the polarity of the magnetic carrier is the same as the polarity of the charge of the electrostatic latent image. Accordingly, the magnetic carrier is left on the sleeve.

The charged toner particles are electrostatically attracted to the electrostatic latent image and also are electrostatically attracted to the magnetic carrier, and in the case where toner particles are excessively attracted to the electrostatic latent image-bearing photosensitive plate, fogging is caused, but if toner particles are excessively attracted to the magnetic carrier, such troubles as reduction of the image density and reduction of the developing efficiency are caused. This threshold value for the development is controlled by adjusting the bias voltage between the photosensitive plate and the sleeve, but adjustment of this bias voltage is limited as a matter of course. For example, if a high bias voltage is applied to produce fogging-preventing development conditions, the density of the formed toner image is generally low.

Also in case of two-component type developers, it is empirically known that at a high toner concentration fogging is readily caused and at a low toner concentration the image density is reduced. Accordingly, the toner is ordinarily mixed with the magnetic carrier so that the toner concentration is 5 to 10% by weight, and the resulting mixture is used for the development.

SUMMARY OF THE INVENTION

While we made research on the properties of particles of the carrier and toner in a two-component type developer, it was found that in this toner/carrier mixture, there is present an optimum toner concentration relatively to the specific surface area of the carrier and the specific surface area of the toner, and if an electrostatic image is developed at this optimum toner concentration, the quantity of the charge on toner particles is increased, fogging is prevented at a low bias voltage, an edge effect is prevented by controlling increase of the electric resistance value and the flowability of the developer is improved. We have now completed the present invention based on this finding.

More specifically, in accordance with the present invention, there is provided a developing method for forming a toner image corresponding to an electrostatic image by bringing an electrostatic image-bearing surface of a photosensitive plate into sliding contact with a magnetic brush consisting of a mixture of a magnetic carrier and an electroscopic toner, wherein development is carried out at a toner concentration (Ct, %) in the mixture, which satisfies the requirement represented by the following formula:

$$Ct = k \cdot \frac{Sc}{St + Sc} \times 100 \quad (1)$$

wherein Sc stands for the specific surface area ($cm^2/g$) of the carrier, St stands for the specific surface area ($cm^2/g$) of the toner, and k is a number of from 0.90 to 1.14.

DETAILED DESCRIPTION OF THE INVENTION

Figure 1:
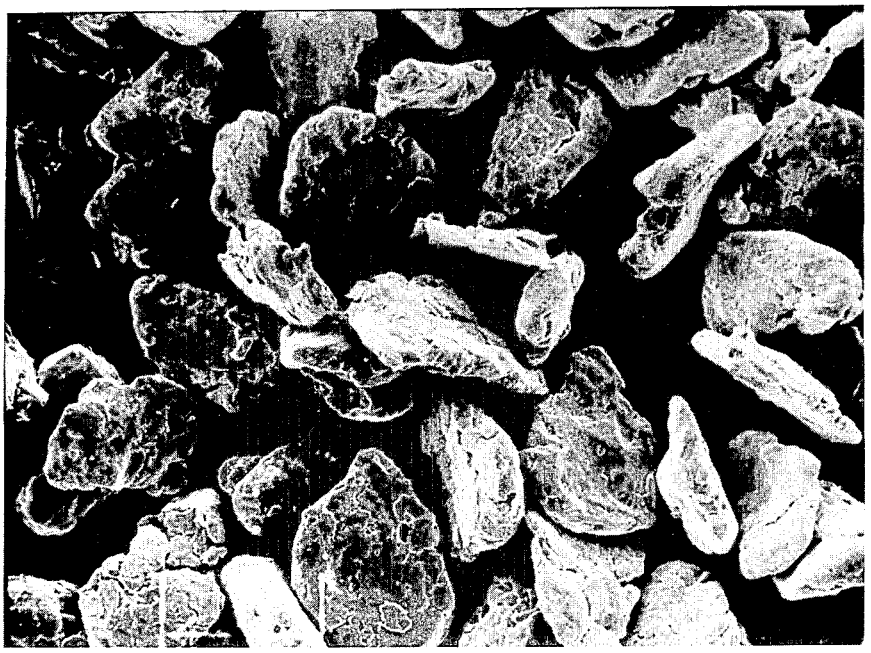
FIGS. 1 through 3 are electron microscope photographs of magnetic carriers of the indeterminate flat iron powder type, indeterminate spherical iron powder type and spherical ferrite type, respectively. In each photograph, the length of the line in the black border corresponds to 100μ.

The present invention is based on the novel finding that a toner concentration optimum for the density of the formed image, prevention of fogging, the resolving degree and the gradation is present relatively to the specific surface area Sc of the carrier and the specific area St of the toner.

In the above formula (1), the term Sc/(St+Sc) of the right side is relative to the specific surface areas of the carrier and toner. More specifically, this term is the value indicating the ratio of the surface area of the carrier to the total surface area of a mixture comprising equal amounts (weights) of the carrier and toner (hereinafter referred to as "carrier surface area occupancy ratio").

In the present invention, development of an electrostatic image with a two-component type developer is carried out under such conditions that the toner concentration is equal to the carrier surface area occupancy ratio or an approximate value thereof, whereby effects of improving the image density, reducing the fog density, improving the resolving degree and improving the gradation can be attained.

The difference between the toner concentration (Ct, %) and the carrier surface area occupancy ratio (Sc/(St+Sc), %) can be evaluated by determining the ratio between them, that is, the following coefficient k:

$$k = Ct/(Sc/(St+Sc))$$

In the present invention, it is critical for the above-mentioned various development characteristics that this coefficient k should be within a certain range, though the preferred range varies to some extent according to the shape of the carrier used. More specifically, in the case of a magnetic carrier having an indeterminate shape, it is necessary that the coefficient k should be within a range of from 0.90 to 1.14 and in the case of a spherical magnetic carrier, it is necessary that the coefficient k should be within a range of from 0.80 to 1.07. This criticality will be readily understood from the results of Examples given hereinafter, which are shown in Tables 3 and 5. Namely, from these results, it will become apparent that if the coefficient k is within the above-mentioned range, the image density, fog density, resolving power and gradation are excellent over those obtained when the coefficient k is too small or too large and outside the above-mentioned range, and that these excellent characteristics are attained not only at the initial stage of the copying operation but also after 10000 prints have been continuously prepared.

The range of the value k in the case of a magnetic carrier of an indeterminate shape is slightly different from the range of the value k in the case of a spherical magnetic carrier. In short, the range for a spherical magnetic carrier is shifted to a smaller value side. This means that the toner concentration for a spherical magnetic toner is shifted to a lower concentration side. We consider that the reason is as follows.

Formation of brush marks on an image (fine white streaks in a solid black portion) or reduction of the resolving degree is greatly infuenced by leak of charges between the magnetic carrier and the electrostatic latent image at the time of the development, and this leak of charges is more readily caused as more corners are present on the surfaces of the magnetic carrier particles. Accordingly, as the degree of the surface exposure of the carrier in the developer is increased with reduction of the toner concentration, leak of charges is more readily caused in a carrier having an indeterminate shape than in the case of a spherical carrier. Therefore, when a spherical carrier is used, an allowable range of the toner concentration is broadened to a lower concentration side. On the other hand, at a higher toner concentration, since a magnetic toner having an indeterminate shape is irregular in the shape, the indeterminate carrier has a higher toner absorbing and retaining capacity, and hence, an allowable range for the indeterminate carrier is shifted to a higher toner concentration side as compared with the allowable range for a spherical carrier.

It is quite a surprising fact that in the present invention, the optimum toner concentration (Ct, %) is determined depending on the above-mentioned carrier surface area occupancy ratio.

Figure 2:
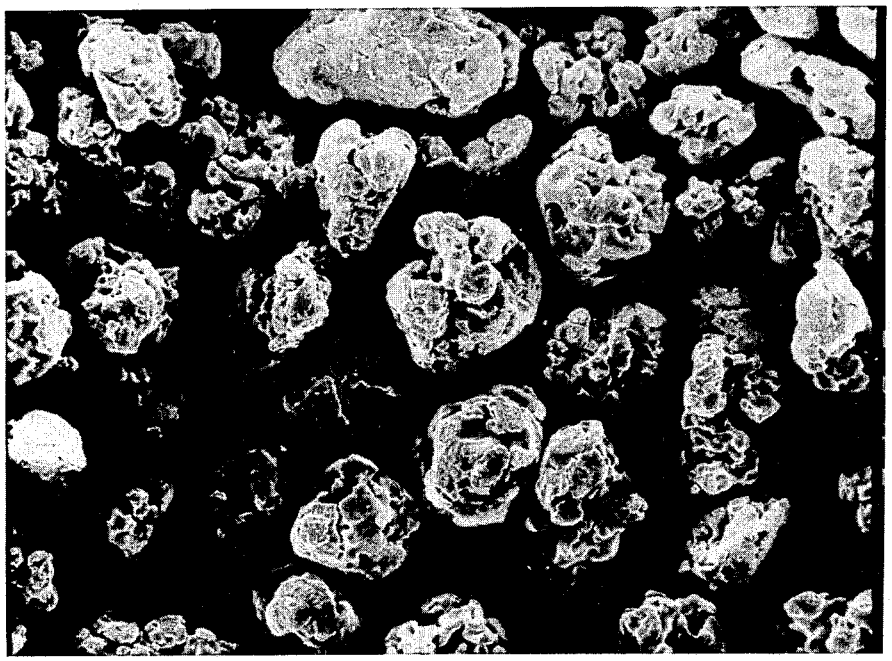
Figure 3:
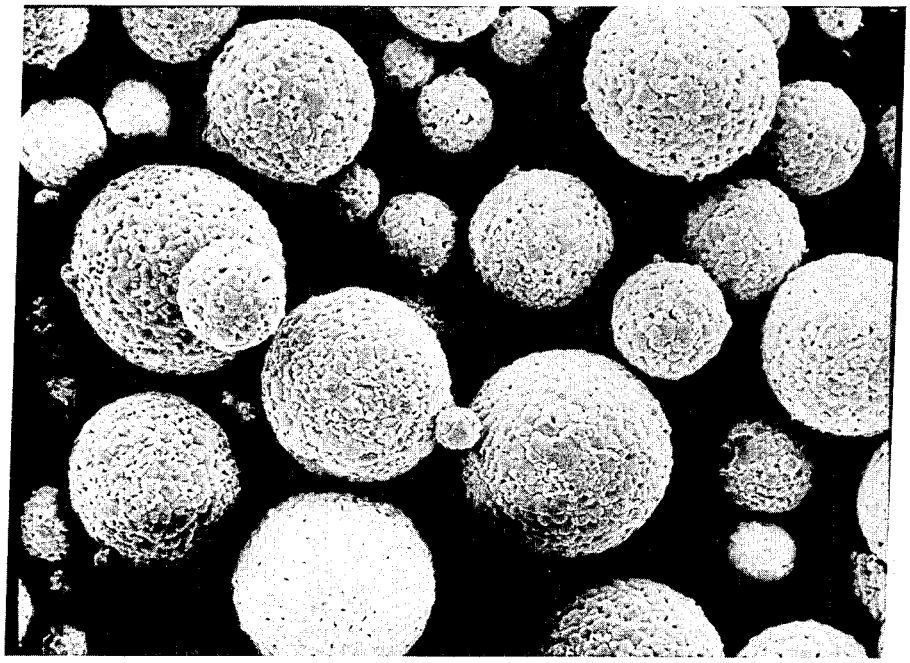

Any of magnetic carriers customarily used in the field of electrophotographic reproduction can optionally be used as the magnetic carrier in the present invention. For example, an iron powder carrier and a ferrite carrier can be used. As regards the shape of the carrier, there may be used a magnetic carrier having an indeterminate shape and a magnetic carrier having a spherical shape. For example, as the indeterminate magnetic carrier, there may be used an indeterminate flat carrier (as shown in the electron microscope photograph of FIG. 1) of the iron powder type and an indeterminate spherical carrier (as shown in the electron microscope photograph of FIG. 2) of the iron powder type, and as the spherical magnetic carrier, there may be used a ferrite carrier or spherical iron powder type magnetic carrier (as shown in the electron microscope photograph of FIG. 3). The particle size (number average particle size) of the magnetic carrier is ordinarily 40 to 110 microns and especially 40 to 60 microns, and since the particle size of the magnetic carrier is within this range, the specific surface area of the magnetic carrier is ordinarily within a range of 50 to 500 $cm^2/g$ and especially within a range of 300 to 400 $cm^2/g$.

A preferred example of the magnetic carrier is a corner-rounded indeterminate iron powder (hereinafter referred to as "indeterminate spherical iron powder"), and an indeterminate spherical iron powder having such a particle size distribution that particles having a size smaller than 105 microns occupy at least 90% by weight of the total particles and particles having a size of 37 to 74 microns occupy at least 50% by weight of the total particles and also having a loose apparent specific gravity of 2.65 to 3.20 g/cc is especially preferably used.

Another preferred example of the magnetic carrier is a so-called ferrite carrier, and sintered ferrite particles, especially spherical sintered ferrite particles, are advantageously used. It is ordinarily preferred that the size of sintered ferrite particles be in the range of from 20 to 100 microns.

If the particle size of the sintered ferrite particles is smaller than 20 microns, it is difficult to obtain good earing of the magnetic brush, and if the particle size of the sintered ferrite particles is larger than 100 microns, the above-mentioned brush marks, that is, scratches, are readily formed on the obtained toner image.

The sintered ferrite particles used in the present invention are known. For example, there may be used sintered ferrite particles having a composition comprising at least one member selected from zinc iron oxide ($ZnFe_2O_4$), yttrium iron oxide ($Y_3Fe_5O_{12}$), cadmium iron oxide ($CdFe_2O_4$), gadolinium iron oxide ($Cd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$). Sintered ferrite particles composed of zinc manganese iron oxide are especially preferred for attaining the objects of the present invention.

Any of coloring toners having electroscopic and fixing characteristics can be used as the toner in the present invention, and a granular composition having a particle size of 5 to 30 microns, which is formed by dispersing a coloring pigment, a charge controlling agent and other additives in a binder resin, is used. As the binder resin, there are used thermoplastic resins, uncured thermosetting resins and precondensates of thermosetting resins. As preferred examples, there can be mentioned, in the order of importance, a vinyl aromatic resin, an acrylic resin, a polyvinyl acetal resin, a polyester resin, an epoxy resin, a phenolic resin, a petroleum resin and an olefin resin. As the pigment, there can be used, for example, at least one member selected from carbon black, cadmium yellow, molybdenum orange, Pyrazolone Red, Fast Violet B and Phthalocyanine Blue, and as the charge controlling agent, there may be used oil-soluble dyes such as Nigrosine Base (CI 50415), Oil Black (CI 26150) and Spiron Black, and metal salts of napthenic acid, metal soaps of fatty acids and soaps of resin acids according to need. A preferred toner is one prepared by melt-kneading the above-mentioned composition, cooling the melt, pulverizing the solid and, if necessary, classifying the resulting particles.

The toner used in the present invention has ordinarily a specific surface area of 3400 to 11000 $cm^2/g$, preferably 4000 to 7000 $cm^2/g$ and especially preferably 4000 to 5000 $cm^2/g$. The value of the specific surface area is a value of an effective specific surface area calculated from the average particle size measured by a Coulter counter based on the supposition that the toner particles have a shape of a true sphere. Namely, the specific surface area of the toner is calculated according to the following formula:

$$St = \frac{3}{r \cdot \rho} \ (cm^2/g)$$

wherein St represents the specific surface area of the toner, r stands for the radius (cm) determined from the volume average particle size measured by a Coulter counter, and $\rho$ stands for the true specific gravity ($g/cm^3$) of the toner.

The reason why the specific surface area is determined in the above-mentioned manner is as follows.

It is noted that the diameter of the toner is much smaller than the diameter of the carrier, and since the toner has a frictional contact with the carrier only through convexities on the surface of the toner, it is presumed that only the surface of these convexities is effective for frictional charging. Based on this presumption, the shape of the toner is approximated to a shape of a true sphere having only the surface of the convexities as the surface area.

However, the specific surface area Sc of the carrier is a value actually measured by the transmission method, which is described in detail in "Handbook of Measurements of Powders and Particles", pages 108 through 113, compiled by the Japanese Powder Industry Association and published by Nikkan Kogyo Shinbunsha.

The above-mentioned magnetic carrier and toner are mixed at such a ratio that the requirement of the formula (1) is satisfied, to form a charged composite of the carrier and toner, and the charged composite is supplied on a developing sleeve having a magnet arranged in the interior thereof, to form a magnetic brush. An electrophotographic photosensitive layer having an electrostatic latent image is brought in sliding contact with this magnetic brush, whereby a toner image corresponding to the electrostatic latent image is formed.

The toner concentration in the two-component type developer in the developing mechanism is gradually reduced with advance of the development. According to one preferred embodiment of the present invention, a micro-computer control mechanism is disposed between a toner concentration detecting mechanism (for example, a level sensor) and a toner supply mechanism in the developing mechanism. In this control mechanism, the values of Sc and St in the above formula (1) are set, and the standard toner concentration Cto (the toner concentration when k is equal to 1) is set. When the ratio of the concentration Ct calculated from the value detected by the level sensor to the standard toner concentration Cto, that is, the value k, becomes equal to the lower limit value of 0.90 or becomes close thereto, the toner supply mechanism is actuated to supply the toner until the value k becomes equal to the upper limit value of 1.14 or close thereto.

Thus, a toner image having a high quality can always be formed.

The present invention will now be described in detail with reference to the following Examples that by no means limit the scope of the invention.

PREPARATION OF DEVELOPER

(1) Carrier Component

Iron powder carriers shown in Table 1 were used.

TABLE 1

| Carrier No. | Shape | Particle Size (μ) | Apparent Density ($g/cm^3$) | Specific Surface Area ($cm^2/g$) | Appropriate Toner Concentration* (%) |
|---|---|---|---|---|---|
| 1 | indeterminate spherical | 53 | 3.16 | 319 | 7.16 |
| 2 | indeterminate spherical | 60 | 3.02 | 258 | 5.87 |
| 3 | indeterminate | 104 | 3.23 | 172 | 3.99 |
| 4 | indeterminate flat | 50 | 2.57 | 416 | 9.14 |
| 5 | spherical | 41 | 2.46 | 367 | 8.15 |

Note
*The appropriate toner concentration is the value calculated from the specific surface areas of the toner and carriers on the supposition that k is equal to 1 when the toner described below (having a specific surface area of 4136 $cm^2/g$) is used.

| (2) Toner Component | |
|---|---|
| Himer SBM-73 (styrene type resin supplied by Sanyo Kasei Kogyo K. K.) | 87 parts by weight |
| Viscol 550P (low-molecular-weight polypropylene supplied by Sanyo Kasei Kogyo K. K.) | 5 parts by weight |
| Special Black 4 (carbon black supplied by Degussa Co.) | 5.5 parts by weight |
| Bontron S-32 (dye supplied by Orient Kagaku K. K. | 1.5 parts by weight |

The above components were sufficiently melt-kneaded and dispersed by a hot three-roll mill, and after cooling, the mixture was roughly pulverized to about 2 mm by a rough pulverizer Rotoplex Cutting Machine supplied by Alpine Co.) and then finely pulverized to about 10 to about 20μ by an ultrasonic jet mill (supplied by Nippon Pneumatic Mfg. Co., Ltd.).

The specific surface area of the toner was 4136 $cm^2/g$.

EXAMPLE 1

Developers a through f having toner concentrations of 4, 6, 7, 8, 9 and 11% by weight, respectively, were formed by using the carrier No. 1. Each developer was subjected to the copying test by using a copying machine provided with an a-Si photosensitive drum in which the steps of charging, light exposure, development and transfer were repeated according to a known copying process. The development conditions were as shown in Table 2. The results obtained when 10000 prints were formed are shown in Table 3.

TABLE 2

| Developer | Development Bias Voltage (V) | Resistance (Ω) between Drum and Sleeve | Specific Charge (μC/g) of Toner |
|---|---|---|---|
| a | 60 | $3.1 \times 10^6$ | 26.3 |
| b | 60 | $4.7 \times 10^6$ | 28.1 |
| c | 60 | $5.4 \times 10^6$ | 28.1 |
| d | 75 | $1.40 \times 10^7$ | 27.8 |
| e | 80 | $1.65 \times 10^7$ | 25.7 |

TABLE 2-continued

| Developer | Development Bias Voltage (V) | Resistance (Ω) between Drum and Sleeve | Specific Charge (μC/g) of Toner |
|---|---|---|---|
| f | 105 | $3.39 \times 10^7$ | 18.5 |

Note
Development Bias Voltage: The bias voltage which was applied so that the fog density at the start was lower than 0.004.
Resistance between Drum and Sleeve: The resistance which was calculated from the value of the current flowing when an aluminum tube drum was attached instead of the photosensitive drum, a voltage of 200 V was applied to the aluminum tube drum from the developing sleeve and the drum was rotated at an ordinary copying speed.

The values k at the toner concentrations of 7 and 8% by weight are calculated according to the above-mentioned formula (1) as follows:

k=1.12 (at a toner concentration of 8% by weight)

k=0.97 (at a toner concentration of 7% by weight)

EXAMPLE 2

The copying test was carried out in the same manner as described in Example 1 except that an Se photosensitive material was used and the carrier No. 4 was used. The developing conditions and the results of the copying test were shown in Tables 4 and 5.

TABLE 3

| Developer | Value k | Image Density | | Fog Density by Scattering | | Resolving Degree | | Gradation | |
|---|---|---|---|---|---|---|---|---|---|
| | | initial stage | 10000th print | initial stage | 10000th print | initial stage | 10000th print | initial stage | 10000th print |
| a | 0.56 | 0.873 | 0.891 | 0.171 | 0.189 | 6.3 | 6.3 | X | X |
| b | 0.84 | 1.051 | 1.008 | 0.190 | 0.185 | 7.1 | 6.3 | X | X |
| c | 0.97 | 1.384 | 1.348 | 0.210 | 0.221 | 7.1 | 7.1 | | |
| d | 1.12 | 1.419 | 1.339 | 0.212 | 0.217 | 7.1 | 7.1 | | |
| e | 1.26 | 1.309 | 1.114 | 0.226 | 0.241 | 5.6 | 5.6 | Δ | X |
| f | 1.54 | 1.133 | 1.015 | 0.235 | 0.260 | 5.6 | 5.6 | X | X |

Note
Resolving Degree: lines/mm
Gradation:
: good gradation from the low density region to the high density region
Δ: reproduction was possible in the low density region but gradation was poor in the high density region
X: reproduction was impossible in the low density region but gradation was good in the high density region

TABLE 4

| Toner Concentration (% by weight) | Value k | Developing Bias Voltage (V) | Resistnace (Ω) between Drum and Sleeve | Specific Charge (μC/g) of Toner |
|---|---|---|---|---|
| 8.0 | 0.87 | 110 | $1.11 \times 10^7$ | 28.1 |
| 9.0 | 0.98 | 110 | $1.39 \times 10^7$ | 29.1 |
| 9.5 | 1.04 | 115 | $1.74 \times 10^7$ | 28.6 |
| 10.5 | 1.15 | 135 | $2.92 \times 10^7$ | 27.1 |
| 12 | 1.31 | 180 | $5.19 \times 10^7$ | 23.5 |

TABLE 5

| Value k | Toner Concentration (% by Weight) | Image Density | | Fog Density by Scattering of Toner | | Resolving Degree | | Gradation | |
|---|---|---|---|---|---|---|---|---|---|
| | | initial stage | 10000th print | initial stage | 10000th print | initial stage | 10000th print | initial stage | 10000th print |
| 0.87 | 8.0 | 1.079 | 1.004 | 0.140 | 0.150 | 6.3 | 5.6 | X | X |
| 0.98 | 9.0 | 1.304 | 1.349 | 0.138 | 0.156 | 7.1 | 7.1 | | |
| 1.04 | 9.5 | 1.414 | 1.368 | 0.143 | 0.151 | 7.1 | 7.1 | | |
| 1.15 | 10.5 | 1.433 | 1.351 | 0.139 | 0.170 | 5.6 | 5.6 | Δ | Δ |
| 1.31 | 12.0 | 1.260 | 1.090 | 0.157 | 0.180 | 5.6 | 5.6 | Δ | X |

From the foregoing results, it is seen that when the carrier No. 1 was used, the image density became substantially saturated at the toner concentration exceeding 7% by weight (developer d) and if the toner concentration was 6% by weight or lower (developers a and b), the image density was considerably low and brush marks were formed.

The resolving degree and gradation were highest at the toner concentrations 7 and 8% by weight (developers c and d) and were relatively good on the lower toner concentration side. If the toner concentration was 9% by weight or higher (developers e and f), the resolving degree was reduced by thickening of letters and the fog density was increased by scattering of the toner.

Accordingly, it was found that when the carrier No. 1 was used, the appropriate concentration of the toner was 7 to 8% by weight.

From the results shown in Table 5, it is seen that at toner concentrations of 9.0 and 9.5% by weight, good results were obtained.

EXAMPLE 3

The copying test was carried out in the same manner as described in Example 1 except the carrier No. 2 or 3 was used. In the case of the carrier No. 2, good results were obtained at a toner concentration of 6% by weight, and if the toner concentration was 7% by weight or higher, thickening of letters or fogging was caused and if the toner concentration was 5% by weight, the image density was low and brush marks were formed in the obtained prints though fogging was not caused.

In the case of the carrier No. 4, good results were obtained at a toner concentration of 4% by weight, and if the toner concentration was 5% by weight, thickening of letters or fogging was caused and if the toner concentration was 3.5% by weight, the image density was low and no good prints were obtained.

When the results obtained in Examples 1 through 3 were examined, it is seen that when any of the carriers Nos. 1 through 4 was used, if the requirement of the above formula, derived from the specific surface area of the toner and carrier, was satisfied, good results were obtained.

EXAMPLE 4

The copying test was carried out in the same manner as described in Example 1 except the spherical carrier No. 5 (ferrite type carrier) was used. The obtained results are shown in Table 6.

TABLE 6

| Toner Concentration (% by weight) | Value k | Image Density | | Fog Density | | Resolving Degree | | Gradation | |
|---|---|---|---|---|---|---|---|---|---|
| | | initial stage | 10000th print | initial stage | 10000 print | initial stage | 10000th print | initial stage | 10000th print |
| 5.13 | 0.63 | 1.150 | 1.130 | 0.158 | 0.174 | 6.3 | 6.3 | X | X |
| 6.50 | 0.79 | 1.401 | 1.311 | 0.165 | 01.74 | 6.3 | 6.3 | Δ | Δ |
| 7.17 | 0.88 | 1.406 | 1.369 | 0.173 | 0.174 | 6.3 | 6.3 | | |
| 8.15 | 1.00 | 1.404 | 1.374 | 01.79 | 0.191 | 6.3 | 6.3 | | |
| 9.13 | 1.12 | 1.220 | 1.121 | 0.201 | 0.235 | 5.6 | 5.6 | Δ | X |
| 11.17 | 1.37 | 0.671 | 0.588 | 0.231 | 0.260 | 5.6 | 5.6 | X | X |

From the foregoing results, it is seen that appropriate copied images were obtained when the toner concentrations were 7.17 and 8.15% by weight, that is, the values k were 0.88 and 1.00, and it also is seen that the value k of 0.79 was a critical value with respect to the gradation. This critical value was shifted to a smaller value side as compared with the values in Examples 1 through 3. It is considered that the reason was that the allowable range was broadened to a lower toner concentration side because the spherical carrier was used.

We claim:

1. A developing method for forming a toner image corresponding to an electrostatic image by bringing an electrostatic image-bearing surface of a photosensitive plate into sliding contact with a magnetic brush consisting of a mixture of magnetic carrier of an indeterminate shape and an electroscopic toner, wherein development is carried out at a toner concentration, in said mixture, which satisfies the requirement represented by the following formula:

$$Ct = k \cdot \frac{Sc}{St + Sc} \times 100$$

wherein

Ct stands for said toner concentration in percent by weight,

Sc stands for the specific surface area ($cm^2/g$) of the carrier determined by the transmission method of the Japanese Powder Industry Association, St stands for the specific surface area ($cm^2/g$) of the toner calculated according to the formula $$St = \frac{3}{r \cdot \rho}$$

wherein r represents the radius (cm) determined from the volume average particle size of the toner measured by a Coulter counter, and $\rho$ represents the true specific gravity ($g/cm^3$) of the toner, and k is a number of from 0.90 to 1.14.

2. A developing method according to claim 1, wherein the magnetic carrier of an indeterminate shape is an iron powder type carrier having an indeterminate spherical shape or indeterminate flat shape.

3. A developing method according to claim 1, wherein the specific surface area (Sc) of the carrier is 50 to 500 $cm^2/g$ and the specific surface area (St) of the toner is 3400 to 11000 $cm^2/g$.

4. A developing method for forming a toner image corresponding to an electrostatic image by bringing an electrostatic image-bearing surface of a photosensitive plate into sliding contact with a magnetic brush consisting of a mixture of spherical magnetic carrier and an electroscopic toner, wherein development is carried out at a toner concentration, in said mixture, which satisfies the requirement represented by the following formula:

$$Ct = k \cdot \frac{Sc}{St + Sc} \times 100$$

wherein

Ct stands for said toner concentration in percent by weight,

Sc stands for the specific surface area ($cm^2/g$) of the carrier determined by the transmission method of the Japanese Powder Industry Association, St stands for the specific surface area ($cm^2/g$) of the toner calculated according to the formula $$St = \frac{3}{r \cdot \rho}$$

wherein r represents the radius (cm) determined from the volume average particle size of the toner measured by a Coulter counter, and $\rho$ represents the true specific gravity ($g/cm^3$) of the toner, and k is a number of from 0.80 to 1.07.

5. A developing method according to claim 4, wherein the spherical magnetic carrier is a ferrite type carrier.

6. A developing method according to claim 4, wherein the specific surface area (Sc) of the carrier is 50 to 500 $cm^2/g$ and the specific surface area (St) of the toner is 3400 to 11000 $cm^2/g$.

7. A method for preparing a carrier/toner mixture useful in magnetic brush image development and comprising a magnetic carrier and an electroscopic toner, wherein the specific surface area (Sc) of the carrier and the specific surface area (St) of the toner are measured and the mixture prepared having a toner concentration (Ct, % by weight) substantially equal to the ratio of the surface area of the carrier to the total surface area of a mixture comprising equal amounts of the carrier and toner and represented by the following formula:

$$Ct = k \cdot \frac{Sc}{St + Sc} \times 100$$

wherein

Sc stands for the specific surface area ($cm^2/g$) of the carrier determined by the transmission method of the Japanese Powder Industry Association, St stands for the specific surface area ($cm^2/g$) of the toner calculated according to the formula $$St = \frac{3}{r \cdot \rho}$$

wherein r represents the radius (cm) determined from the volume average particle size of the toner measured by a Coulter counter, and $\rho$ represents the true specific gravity ($g/cm^3$) of the toner, and k is a number between 0.80 to 1.07 for a spherical carrier and 0.90 to 1.14 for an indeterminate shape carrier.

* * * * *